US008770264B2

(12) United States Patent
Lange et al.

(10) Patent No.: US 8,770,264 B2
(45) Date of Patent: Jul. 8, 2014

(54) DEVICE, GUTTER, METHOD FOR TILT-CASTING COMPONENTS MADE OF LIGHT METAL, AND COMPONENTS CAST THEREWITH

(75) Inventors: Uwe Lange, Wernigerode (DE); Holger Oppelt, Bad Suderode (DE); Andreas Strube, Schellerten (DE)

(73) Assignee: KSM Castings Group GmbH, Hildesheim (DE)

( * ) Notice: Subject to any disclaimer, the term of this patent is extended or adjusted under 35 U.S.C. 154(b) by 0 days.

(21) Appl. No.: 13/375,858

(22) PCT Filed: Jun. 14, 2010

(86) PCT No.: PCT/DE2010/000662
§ 371 (c)(1),
(2), (4) Date: Jan. 9, 2012

(87) PCT Pub. No.: WO2011/000343
PCT Pub. Date: Jan. 6, 2011

(65) Prior Publication Data

US 2012/0132321 A1 May 31, 2012

(30) Foreign Application Priority Data

Jul. 3, 2009 (DE) ..... 10 2009 031 852

(51) Int. Cl.
*B22D 35/04* (2006.01)
*B22D 41/04* (2006.01)

(52) U.S. Cl.
USPC ..... 164/136; 164/336

(58) Field of Classification Search
USPC ..... 164/335, 336, 337, 322, 133, 135, 136
See application file for complete search history.

(56) References Cited

U.S. PATENT DOCUMENTS

| | | | | |
|---|---|---|---|---|
| 4,072,180 | A | 2/1978 | Hoult | |
| 4,614,217 | A * | 9/1986 | Keaton | 164/137 |
| 5,704,413 | A | 1/1998 | Takasaki | |
| 6,929,053 | B1 | 8/2005 | Doty | |
| 2006/0175033 | A1 | 8/2006 | Meyer | |

FOREIGN PATENT DOCUMENTS

| | | |
|---|---|---|
| DE | 21 64 755 | 7/1973 |
| DE | 10 2004 01564 | 8/2005 |
| DE | 10 2006 058142 | 6/2008 |
| KR | 2009 0006502 | 1/2009 |

OTHER PUBLICATIONS

"Giessereilexikon" [Foundry Lexicon], 16th edition, 1994, p. 244 and p. 655. (Spec., p. 1).
Kahn F: "Prozessleittechnik Und Qualitaettssicherung Beim Giessen Am Beispiel er Ne-Metallgussfertigung" Giesserei, Giesserei Verlag, Dussledorf, DE, vol. 80, No. 17, Sep. 6, 1993, pp. 579-584. (ISR).
International Search Report of PCT/DE2010/000662, date of mailing Oct. 14, 2010.

* cited by examiner

*Primary Examiner* — Kevin P Kerns
(74) *Attorney, Agent, or Firm* — Collard & Roe, P.C.

(57) ABSTRACT

A device for casting components preferably made of light metal, according to the tilt-casting principle, has a casting mold that can be tilted about its longitudinal axis, a casting channel that is disposed on the casting mold, in the longitudinal direction of the casting mold, the longitudinal side of which, facing the casting mold, has at least two outlets to the mold cavity, or at least one outlet, in each instance, to at least two mold cavities that are disposed next to one another and do not stand in a flow connection with one another. The casting channel has a subdivision device that is configured in such a manner that when the casting mold, together with the casting channel, is tilted, predetermined volumes of the casting melt flow through the outlets.

20 Claims, 4 Drawing Sheets

DEVICE, GUTTER, METHOD FOR TILT-CASTING COMPONENTS MADE OF LIGHT METAL, AND COMPONENTS CAST THEREWITH

CROSS REFERENCE TO RELATED APPLICATIONS

This application is the National Stage of PCT/DE2010/000662 filed on Jun. 14, 2010, which claims priority under 35 U.S.C. §119 of German Application No. 10 2009 031 852.6 filed on Jul. 3, 2009, the disclosure of which is incorporated herein by reference. The international application under PCT article 21(2) was not published in English.

BACKGROUND OF THE INVENTION

1. Field of the Invention

The invention relates to an apparatus, a casting channel, and a method for tilt-casting of components made of light metal, as well as components cast with it.

2. The Prior Art

In the tilt-casting method, which is described very generally in the standard work "Gieβereilexikon" [Foundry Lexicon], 16$^{th}$ edition, 1994, p. 244 and p. 655, a coquille is rotated about a tilt axis by up to 90°, while the melt flows into the coquille. It is advantageous that in this way, the coquille can be filled with the melt without flow turbulences. It is particularly advantageous, in this connection, that the splashing melt that might occur during casting can be avoided, by means of guiding the melt along a wall of the casting mold.

A method for casting components made of light metal, particularly of aluminum alloys, in accordance with the tilt-casting principle, as well as a corresponding apparatus for carrying out such a method, are known from DE 10 2004 015 649 B3. In this method, the melt is filled into a transverse run situated on the longitudinal side of a casting mold, using head-casting. In this connection, the casting mold is first tilted about its longitudinal axis by an angle of 45° to 70°. Afterward, filling the liquid melt into the transverse run starts, until about ⅕ of the melt required for casting of the component has been filled into the transverse run, without the melt already flowing into the mold cavity of the casting mold. Subsequently, the casting mold is rotated out of the tilted position into the vertical, while continuously filling in further melt, in such a manner that the melt flows into the mold cavity along a casting mold wall.

A disadvantage of the method disclosed in DE 10 2004 015 649 B3 consists in that the melt is at first only partly filled into the transverse run, before pouring of the melt into the coquille starts. In this connection, the risk can exist that temperature losses occur. It is furthermore disadvantageous that the remaining melt required for the casting process must be filled in continuously during tilt-casting, and therefore must be refilled into a casting pool of the transverse run, in very complicated manner, by means of a casting ladle. The casting ladle must therefore be guided along synchronously with the tilting of the casting mold, and is not available for any other or further casting process during this time.

As a result of the tilting of the casting mold, the melt flow in the transverse run is deflected by 90°, and then flows into the casting mold through multiple outlets. In this connection, there is the risk, particularly as the result of continuous refilling of the melt by means of a casting ladle, that the melt can flow through the individual outlets and into the casting mold in non-uniform manner, particularly too rapidly or too slowly, in too small or too great an amount.

SUMMARY OF THE INVENTION

Proceeding from this state of the art, the invention is based on the task of making available an apparatus for casting of components made of light metal, according to the tilt-casting principle, with which apparatus new degrees of freedom or possibilities in process management for casting of components are created, eliminating the aforementioned disadvantages, thereby obtaining new component geometries, but particularly also new component properties, for example relating to the internal structure and/or the external composition of the components.

The invention is furthermore based on the task of making available an apparatus for casting of components made of light metal, according to the tilt-casting principle, with which casting mold filling is achieved without significant technical effort, which filling avoids cavities, porosities and/or inclusions in the cast component, even in the case of complicated component geometries.

The invention is furthermore based on the task of making available an apparatus for casting of components made of light metal, according to the tilt-casting principle, with which homogeneous filling of the casting mold with the melt is made possible without temperature losses, to a great extent.

The invention is furthermore based on the task of making available an apparatus for casting of components made of light metal, according to the tilt-casting principle, with which a plurality of components can be cast at the same time, wherein the technical effort is kept low.

As a solution, according to the invention, an apparatus for casting of components, preferably components made of light metal, according to the tilt-casting principle, is now provided, which apparatus comprises a casting mold or coquille that can be tilted about its longitudinal axis, and a casting channel that is disposed on the casting mold, in the longitudinal direction of the latter. The casting channel has at least two outlets to the mold cavity, on its longitudinal side facing the casting mold, or at least one outlet, in each instance, to at least two mold cavities that are disposed next to one another and do not stand in a flow connection with one another. According to the invention, the casting channel furthermore has a subdivision device that is configured in such a manner that when the casting mold is tilted from a starting position into an end position, predetermined or specific volumes of the casting melt flow through the outlets into the mold cavity or into the mold cavities of the casting mold.

With such an apparatus, new degrees of freedom or new possibilities in process management for casting of components are created. If a mold cavity is now filled by means of at least two outlets, it can be predetermined how much melt flows into the mold cavity through which outlet. As a result, new component geometries with new component properties, relating to the internal structure and/or the external composition, can be obtained.

If multiple mold cavities or cavities of a casting mold, which are separated from one another, are filled by way of one outlet, in each instance, uniform, defined filling of the individual mold cavities of the casting mold is achieved by means of the apparatus according to the invention. Complicated component geometries, which have fewer cavities, porosities and/or inclusions in the cast component, can be produced without significant technical effort. In particular, a plurality of components can be cast with such an apparatus according to the invention, in particularly simple, fast, and parallel manner.

Preferably, the subdivided volumes within the casting channel stand in a flow connection in the region of the longitudinal side that lies opposite the outlets. In this way, the casting channel can be filled in particularly simple manner, in that the melt is filled in or introduced only at one location in or on the casting channel.

It can be advantageous if the flow connection amounts to ¼ to ¾ in the transverse direction, preferably ⅓ to ⅔ of the length of the casting channel in the transverse direction. The wider the flow connection, the faster and more uniformly the melt is distributed when it is filled into the casting channel, whereby no temperature losses are to be feared. It has been shown that a subdivision device provided according to the invention, in the lower third or fourth of the casting channel, facing the mold cavity, is sufficient to divide the melt up among the outlets that are present, in predetermined amounts.

It is practical if the casting channel is disposed on the casting mold in such a manner that the casting channel is open upward in the starting position of the casting mold, in other words before tilting. In this way, the melt can be introduced into the casting channel in particularly simple manner.

It can be advantageous if the subdivision device is funnel-shaped or shell-shaped in the region of the outlets. Preferably, such a funnel is configured to be quadragonal in a top view, whereby preferably, one side is missing if the casting channel is open on one side. It is essential to the invention that a delimitation for subdivision is provided between the parallel outlets, within the casting channel, whereby the delimitation preferably drops toward the outlets, in each instance. In this way, the result is achieved that the melt flows through the outlet, in each instance, more uniformly during tilting of the casting mold.

It can be practical if the outlet, in each instance, is disposed at the low point of the subdivision device in the end position of the casting mold, in other words after tilting, and thereby the predetermined amount of melt flows completely into the casting mold, to the greatest possible extent.

It can be advantageous if at least individual ones of the predetermined volumes are the same size or of different sizes. In this way, new degrees of freedom or possibilities in the process management for casting of components can be created, in particular, and as a result, new component geometries, but particularly also new component properties, for example relating to the internal structure and/or the external composition of the components, are obtained.

It can be advantageous if at least individual ones of the outlets are the same or different. In this way, what was said above can be achieved to the same extent.

Preferably, the casting mold, together with the casting channel, can be tilted by up to 90°. A tilting range limited in this manner is sufficient to meet the requirements even of complicated component geometries.

It is practical if the casting channel has a casting pool on one of its face sides. The capacity of the casting channel is preferably such that it completely holds the melt required for the casting in the starting position of the casting mold, in other words before tilting, without inflow of melt into the mold cavity or mold cavities taking place.

It has been shown to be particularly advantageous if at least one further casting mold having one or more mold cavities and a separate casting channel is disposed next to the first casting mold, whereby these molds can be tilted by way of a common tilt axis. In this way, a plurality of components can be cast at the same time or in parallel, in particularly simple and rapid manner, whereby the technical effort is slight.

Preferably, a robot arm is provided, which has a number of casting ladles corresponding to the number of casting channels, preferably two casting ladles, for parallel scooping and transport of the casting melt, as well as for parallel filling of the casting melt into the casting channel. In this way, a plurality of components can be cast at the same time or in parallel, and in particularly fast and simple manner, whereby the technical effort is slight.

It can be advantageous if the casting mold, together with the casting channel, is disposed in such a manner that the casting channel can be filled with melt from the face side. In this way, the melt is distributed in the casting channel particularly quickly. Furthermore, a space-saving arrangement is possible, particularly in the case of an apparatus having multiple casting molds with casting channels.

It can be advantageous if the apparatus has a retainer part, preferably a retainer plate, which can be moved into the casting channel to a predetermined depth, in the region of the casting location of the casting channel, specifically preferably between the casting location and the first outlet or first subdivision device, in such a manner that the casting melt passes through underneath the retainer part when the casting channel is filled, and is distributed in the casting channel, whereby an oxide layer that floats on top of the casting melt is held back at the retainer part when the casting channel is filled, and can be removed later. In this way, this oxide layer is prevented from penetrating into the casting mold cavity/cavities through the outlets of the casting channel, and having a detrimental effect on the quality of the cast products.

It can be advantageous if the apparatus has a number of further retainer parts, preferably disposed on a common crosspiece, preferably retainer plates, which number corresponds to the number of outlets, which parts can be moved into the casting channel up to a predetermined depth, in front of an outlet, in each instance, in such a manner that the casting melt passes through underneath the retainer part when the casting mold is tilted, and flows into the casting mold cavity/cavities, whereby an oxide layer that floats on top of the casting melt situated in the casting channel is held back at the retainer part, and can be removed later. In this way, the oxide layer is prevented from penetrating into the casting mold cavity/cavities through the outlets of the casting channel, and having a detrimental effect on the quality of the cast products.

Preferably, the retainer parts are disposed on a common crosspiece in the manner of a comb that can be moved into the casting channel before casting, and moved out of the casting channel after casting, preferably in such a manner that the oxide layer adheres to the comb when it is moved out, and can be removed from the comb manually or preferably in automated manner, at a different location, preferably stripped off.

After all this, the invention also relates to a corresponding casting channel for placement on a casting mold or coquille, comprising at least two outlets, whereby according to the invention, it is provided that the casting channel has a subdivision device that is configured in such a manner that predetermined volumes of the casting melt flow through the outlets into the mold cavity or into mold cavities of the casting mold or coquille that are disposed next to one another and do not stand in a flow connection with one another.

It is advantageous if the casting channel has at least individual ones of the characteristics discussed below.

It can be particularly advantageous if the casting channel is produced from spheroidal graphite iron, which is also referred to as GJS or GGG. Such a material is particularly suitable for obtaining the desired geometry of the casting channel, whereby the casting channel simultaneously has steel-like mechanical properties.

It is advantageous if the casting channel, preferably only its inside, has a ceramic coating that is preferably sprayed on in multiple layers, in order to avoid adhesion of the melt in the casting channel. It can be advantageous if the coating is repeated after several casting runs.

It can be advantageous if the casting channel is configured to be thin-walled, preferably with a wall thickness of up to 20 mm, preferably up to 12 mm, particularly preferably up to 7 mm. In this way, the result is achieved that the temperature within the melt can be held.

In order to increase the useful lifetime of the casting channel, it can be advantageous if the casting channel is provided with at least one reinforcement element. It can be advantageous if the casting channel has at least one reinforcement notch. It can be advantageous if the casting channel, additionally or alternatively, has at least one reinforcement rib. It can be advantageous if the casting channel, alternatively to the two aforementioned variants or in addition to at least one of the two aforementioned variants, has at least one reinforcement beading. It can be advantageous if the casting channel, alternatively to the two aforementioned variants or in addition to at least one of the two aforementioned variants, has at least one reinforcement bead. Such reinforcement notches, ribs, beadings and/or beads can advantageously be provided on the outside of the casting channel. However, it can also be advantageous if such reinforcement notches, ribs, beadings and/or beads are provided on the inside of the casting channel, as an alternative to the outside or in addition. Reinforcement ribs or crosspieces on the outside of the bottom of the casting channel have proven to be particularly advantageous, whereby these reinforcement ribs or crosspieces are preferably disposed over the length of the casting channel and particularly preferably have at least one interruption.

To accomplish the tasks stated above, a method for casting of a material is also provided, by means of bringing this material into a flowable state, by means of heating same and introducing it into at least one, preferably into two casting molds that can be tilted about a longitudinal axis, according to the tilt-casting principle. In this connection, the at least one casting mold is first rotated or tilted into a starting position, on the side, preferably by up to 120°, particularly preferably by up to 90°, so that a casting channel assigned to each casting mold and provided with at least two outlets comes to lie horizontally next to the casting mold. Then the flowable material is introduced into the casting channel from above. Subsequently, the at least one casting mold, together with the casting channel, is tilted back to the vertical or beyond it, preferably by up to 120°, particularly preferably by up to 90°, so that the flowable material flows, at predetermined volumes, during tilting, through the outlets assigned to the individual volumes, into the at least one mold cavity, preferably into multiple mold cavities, each having at least one outlet and not standing in a flow connection with one another.

It can be practical if a casting channel according to the invention, particularly a casting channel having at least individual ones of the characteristics mentioned herein, which characterize the casting channel, is used in the method.

It can be advantageous if the casting channel is filled with melt from the face side. In this way, the melt is distributed in the casting channel particularly quickly. Furthermore, a space-saving arrangement is possible, particularly when using multiple casting channels and casting ladles.

It can be advantageous if a retainer part, particularly a retainer plate, is moved into the casting channel to a predetermined depth, in the region of the casting location, specifically preferably between the casting location and the first outlet or first subdivision device, in such a manner that the casting melt passes through underneath the retainer part when the casting channel is filled, and is distributed in the casting channel, whereby an oxide layer that floats on top of the casting melt is held back at the retainer part when the casting channel is filled, and can be removed later. In this way, this oxide layer is prevented from penetrating into the casting mold cavity/cavities through the outlets of the casting channel, and having a detrimental effect on the quality of the cast products.

It can be advantageous if a retainer part, preferably a retainer plate, is moved into the casting channel up to a predetermined depth, in front of each outlet, in such a manner that the casting melt passes through underneath the retainer part when the casting mold is tilted, and flows into the casting mold cavity/cavities, whereby an oxide layer that floats on top of the casting melt situated in the casting channel is held back at the retainer part, and can be removed later. In this way, the oxide layer is prevented from penetrating into the casting mold cavity/cavities through the outlets of the casting channel, and having a detrimental effect on the quality of the cast products.

Preferably, the retainer parts are disposed on a common crosspiece in the manner of a comb that can be moved into the casting channel before casting, and moved out of the casting channel after casting, preferably in such a manner that the oxide layer adheres to the comb when it is moved out, and can be stripped off from the comb manually or preferably in automated manner, at a different location.

It can be advantageous if at least and preferably only one core, which is formed from core-forming material, preferably from sand, and an inorganic binder, is placed into every mold cavity of the casting mold.

It has been shown that it is possible to produce highly integrated and complex components using the method according to the invention, which are characterized by an improved surface.

Therefore, it is advantageous that no to only a few individual defects caused by the core placed in the mold, such as pores, cavities, or leaf ribs, can be found in the surface.

The casting method according to the invention, in the form of a combination of tilt-casting according to the invention and inorganic core placed in the mold in advance, has proven to be particularly advantageous in this connection. Thus, complex and, at the same time, high-quality components can be produced, whereby at the same time, a reduction in the cost-intensive subsequent machining or finishing or treatment is achieved. The latter usually form the major bottlenecks in cast production. Therefore cleaning and inspection costs can be saved.

Furthermore, the environmental friendliness of the method according to the invention has proven to be advantageous. Thus, emissions in component production are avoided or reduced.

It is practical if sand or quartz sand is used as the core-forming material. This is particularly well accessible to recycling, after the casting process, quasi as a process residue.

It can be particularly advantageous if no core coating is applied to the core, in order to obtain a defect-free and smooth surface of the cast part, to the greatest possible extent. In this way, a further cost-intensive work step is saved. It has been shown that the combination of tilt-casting with an inorganic, coating-free core leads to a particularly defect-free surface, in other words to a surface without or with only a few cavities, pores, or leaf rib defects. In this way, high-quality and complex components can be cast, which were otherwise only accessible to subsequent machining or finishing with difficulty, according to the state of the art, whereby according to the invention, it is now possible to do without such subsequent machining or finishing, to the greatest possible extent. It is advantageous that disadvantageous adhesions of coating on the cast parts produced do not occur. Despite the absence of coatings, it was also not possible to find any mold material or sand adhesions on the cast part, in the case of the combination, according to the invention, of tilt-casting with an inorganic, coating-free core. In this way, cleaning and inspection costs can be saved.

Preferably, a binder on the basis of silicate, borate and/or phosphate is used as an inorganic binder. This leads to a further improvement in the reduction of possible casting defects. Pores and cavities appear much less frequently, according to the invention.

It is practical if it is provided that when using multiple casting molds disposed on only one tiltable longitudinal axis, the casting channels assigned to the casting molds are filled in parallel. In this way, a plurality of components can be cast, in particularly simple and rapid manner.

The invention also relates to a cast product that consists of a light-metal alloy, preferably an aluminum alloy, which has been produced according to at least one of the preceding claims, using the gravity method.

Finally, the invention also relates to the use of an apparatus, a casting channel and/or a method for casting of a pump housing, particularly a high-pressure pump housing, or of a turbocharger housing.

BRIEF DESCRIPTION OF THE DRAWINGS

In the following, the invention will be explained using an exemplary embodiment that is shown in the drawing. In this drawing, the figures show FIG. 1 the schematic representation of a casting channel with a funnel-shaped subdivision device, in a perspective view, FIG. 2 the schematic representation of a casting channel with a funnel-shaped subdivision device, in a top view, FIG. 3 the schematic representation of a casting mold half, in a perspective view, FIG. 4 the schematic representation of two parallel casting molds, disposed on a tilt axis, as casting mold halves each having a casting channel disposed on it, in a perspective view, FIG. 5 the schematic representation of two parallel casting molds, disposed on a tilt axis, as casting mold halves each having a casting channel disposed on it, in a top view, FIG. 6 the schematic representation of a casting mold composed of two casting mold halves, with a casting channel disposed on it, in the starting position, in a side view, FIG. 7 the schematic representation of a casting mold composed of two casting mold halves, with a casting channel disposed on it, in an intermediate position, in a side view, and FIG. 8 the schematic representation of a casting mold composed of two casting mold halves, with a casting channel disposed on it, in the end position, in a side view.

DETAILED DESCRIPTION OF THE PREFERRED EMBODIMENTS

When the same reference numbers are used in FIGS. 1 to 8, then these refer to the same parts, so that for the purpose of avoiding repetition, a component that has already been described will not be discussed again in every figure description.

Figure 1:
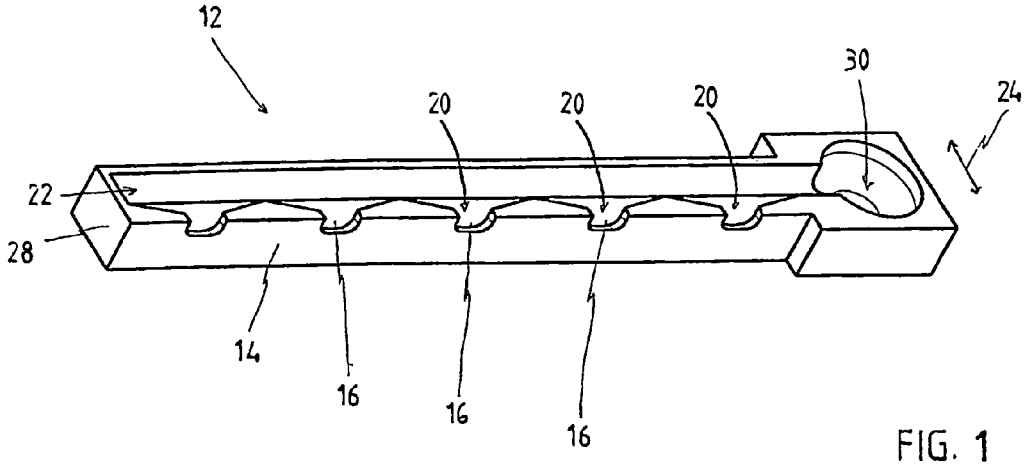

In FIG. 1, a casting channel 12 according to the invention, with a funnel-shaped subdivision device 20 and a casting pool 30 on one of the face sides 28 of the casting channel 12, is shown in a perspective view.

Figure 3:
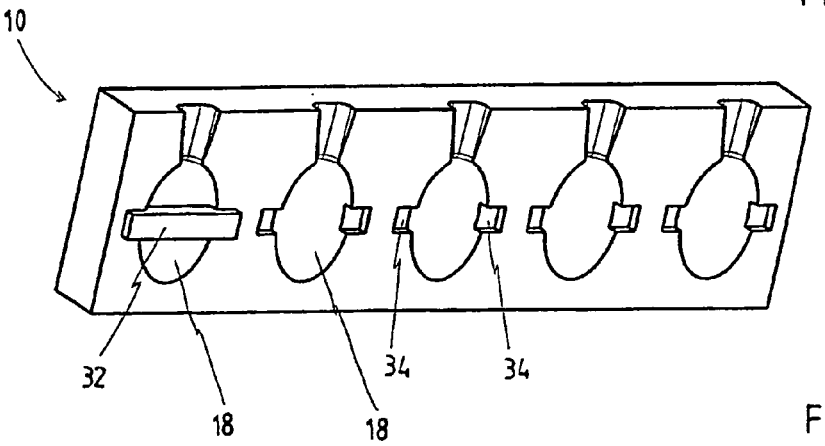

The casting channel 12 has five outlets 16 on the longitudinal side 14 facing the casting mold 10, which outlets can each be connected, individually, with a separate mold cavity 18 of a casting mold, as shown in FIG. 3.

Corresponding mold cavities 18 of a casting mold 10, disposed next to one another and not standing in a flow connection with one another, are shown in FIG. 3, whereby for the sake of simplicity, only one mold half of the casting mold 10 is shown. FIG. 3 therefore shows only one casting mold half 10 with a corresponding half mold cavity 18.

The casting channel 12 has a funnel-shaped subdivision device 20, according to the invention, in the third of the casting channel 12 that faces the longitudinal side 14. This subdivision device 20 is configured in such a manner that when the casting mold 10, together with the casting channel 12, is tilted, the volumes of the casting melt predetermined by the subdivision device flow through the outlets 16.

In the present case, the volumes of the casting melt that flow through the outlet 16, in each instance, are of the same size. The outlets 16 of the casting channel 12, in each instance, also have the same size.

In this way, it is ensured that the mold cavities 18 that follow the outlets 16 are all uniformly filled with the same volume of casting melt. This is practical if a plurality of the same components, particularly pump housings, are being cast at the same time, in other words synchronously, by means of the mold cavities 16.

It can easily be seen that the subdivided volumes within the casting channel 12 generously stand in a flow connection in the region of the longitudinal side 22 that lies opposite the outlets 16, whereby the flow connection in the transverse direction 24 takes up about two-thirds of the length of the casting channel 12 in the transverse direction 24. However, such a subdivision is already sufficient to assign a predetermined volume of casting melt to the individual outlets 16, and to fill the mold cavity 18, in each instance, in uniform and homogeneous manner.

Figure 8:
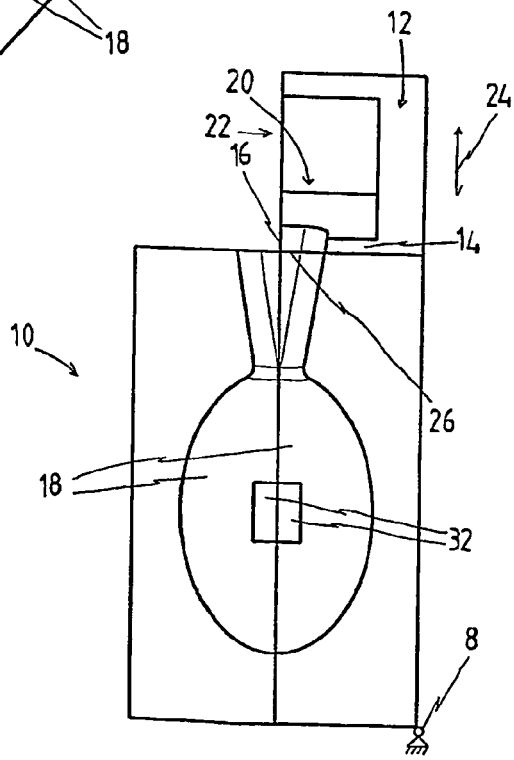

As can clearly be seen in FIG. 8, the outlet 16, in each instance, is disposed at the low point 26 of the subdivision device 20, in the end position of the casting mold 10, in other words after tilting.

The casting channel 12 has a casting pool 30 at one of its face sides 28.

Figure 2:
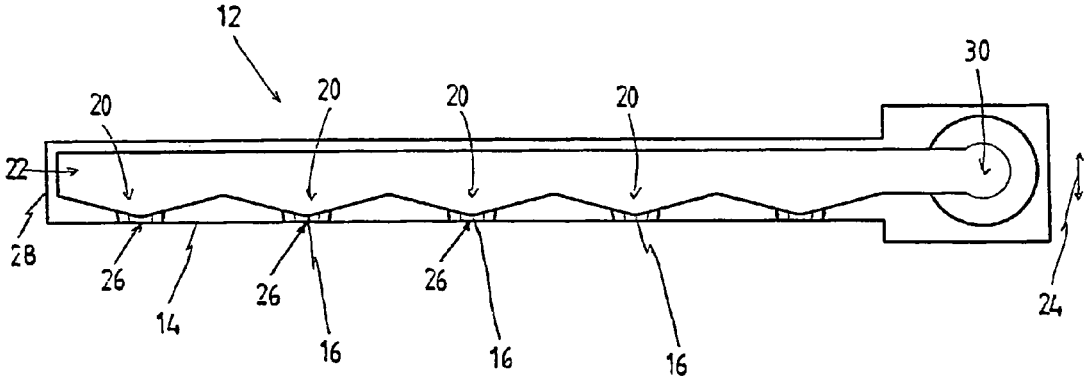

The casting channel 12 shown in FIG. 2 essentially corresponds to the one shown in FIG. 1, but is shown in a top view.

FIG. 3—as has already been said—schematically represents a mold half of a casting mold 10, having five mold cavities 18 that are separated from one another, whereby each mold cavity 18, here also shown only by half, has supports 34 for a core 32, whereby the core 32 is shown as an example in FIG. 3, in the left mold cavity 18.

Figure 4:
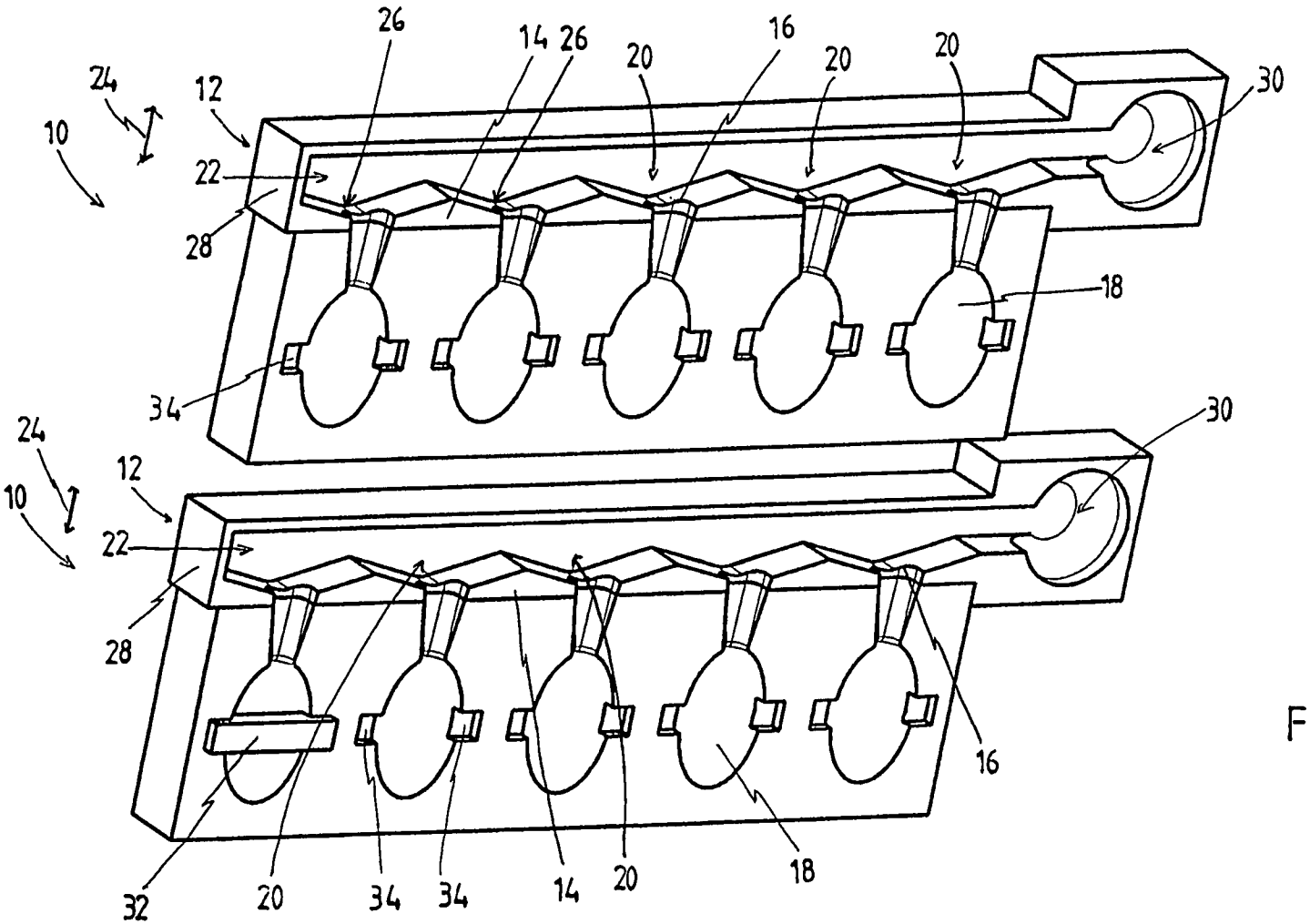

FIG. 4 shows, in perspective, an apparatus according to the invention, having two casting molds 10 or coquilles, disposed parallel, each of which has a casting channel 12 disposed on the casting mold 10 in its longitudinal direction. For the sake of a clearer illustration, however, only one casting mold half 10 of each casting mold 10 is shown.

According to the invention, it is provided that the two casting molds 10, together with the casting channels 12, can be tilted only by way of a common tilt axis 8, not shown here.

Preferably, the apparatus furthermore comprises a robot arm, not shown here, which has two casting ladles for parallel scooping and transport of the casting melt as well as for parallel filling of the casting melt into the casting channels 12 or into the casting pools 30.

Figure 5:
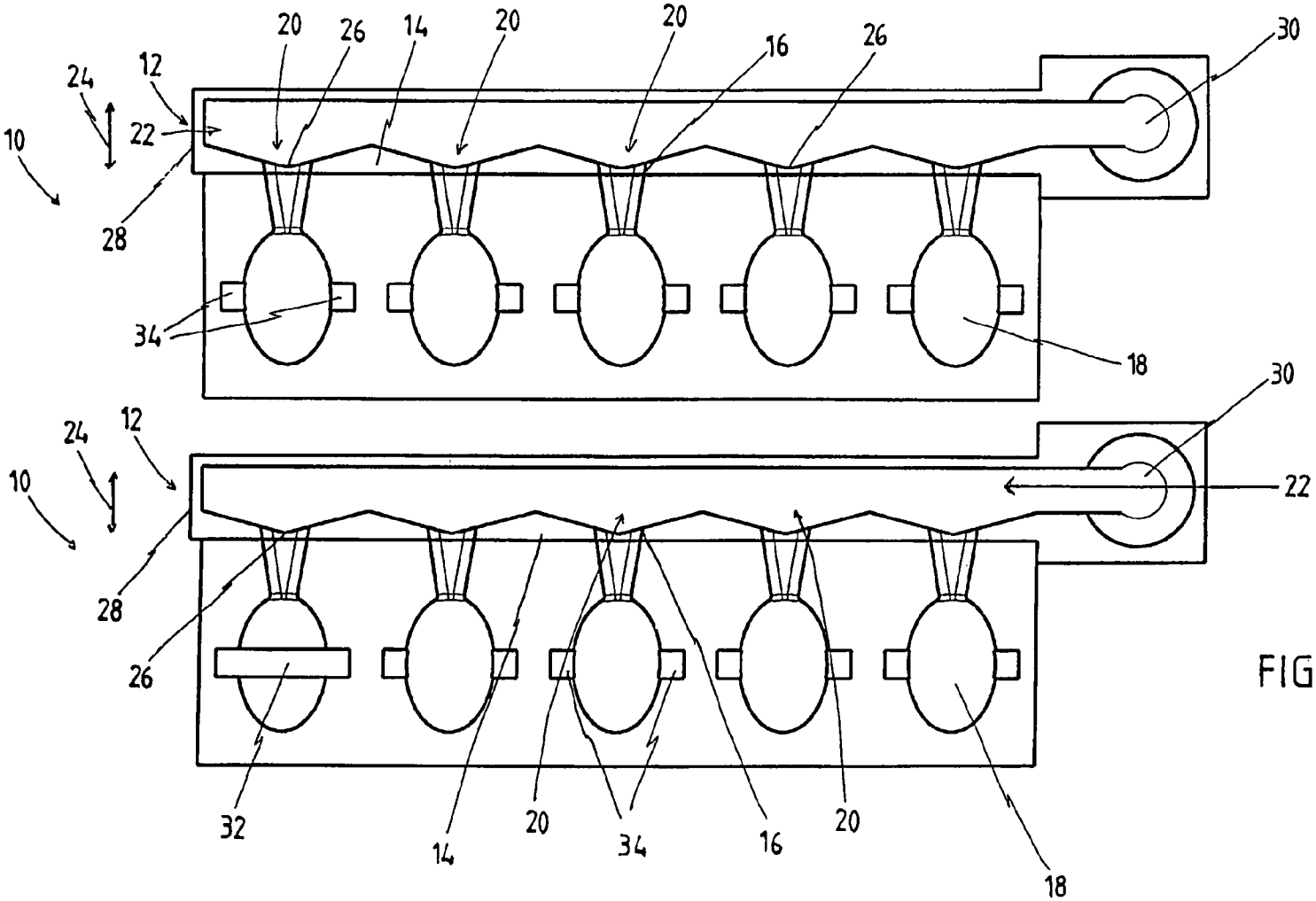

FIG. 5 shows the two casting molds 10 according to the invention, provided on a common tilt axis 8, with the casting channel 12 according to the invention, according to FIG. 4, disposed on them, in each instance, in a top view.

Figure 6:
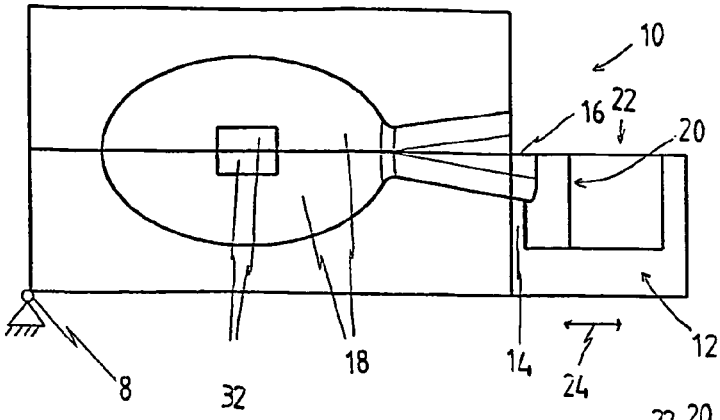
Figure 7:
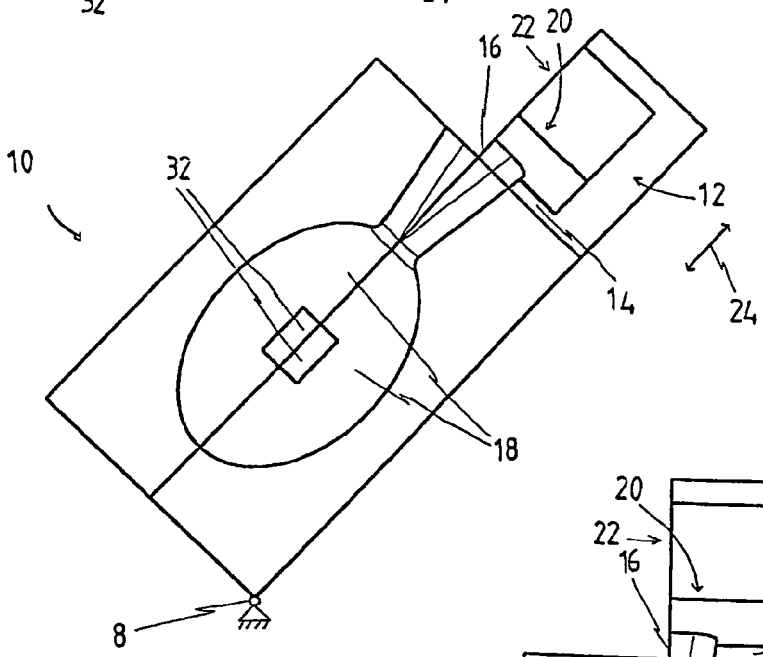

FIGS. 6 to 8 show the casting mold 10 according to the invention, this time composed of two casting mold halves, with a casting channel 12 according to the invention, in three instantaneous views during casting.

In this method for casting of a material by means of bringing same into a flowable state, by means of heating same and introducing it into the casting mold 10 that can be tilted about a longitudinal axis or tilt axis 8, according to the tilt-casting principle, the casting mold 10 is first rotated or tilted into a starting position, on the side or into the horizontal, by 90°, so that a casting channel 12 assigned to the casting mold 10 and provided with at least two outlets 16 comes to lie horizontally next to the casting mold 10, FIG. 6. Then the flowable material is introduced into the casting channel 12 from above. Subsequently, the casting mold 10, together with the casting channel 12, is tilted back to the vertical by 90°, so that the flowable material flows, at a predetermined volume, during tilting, through the outlets 16 assigned to the individual volumes, into the at least one mold cavity, preferably into multiple mold cavities 18, each having at least one outlet and not standing in a flow connection with one another, FIG. 8. FIG. 7 shows an intermediate position of the casting mold 10.

Preferably, each mold cavity 18 has a core 32 that is formed from core-forming material, preferably sand, and an inorganic binder.

Reference Symbol List (Is Part of the Specification)

8 tilt axis
10 casting mold or casting mold half
12 casting channel
14 longitudinal side
16 outlet
18 mold cavity
20 subdivision device
22 region opposite longitudinal side
24 transverse direction
26 low point
28 face side
30 casting pool
32 core
34 core support

The invention claimed is:

1. Apparatus for casting of components according to a tilt-casting principle, having a casting mold that is tilted about its longitudinal axis, a casting channel that is disposed on the casting mold, in the longitudinal direction of the casting mold, a longitudinal side of the casting channel, facing the casting mold, has at least two outlets to a mold cavity of the casting mold, or at least one outlet, in each instance, to at least two mold cavities of the casting mold that are disposed next to one another and do not stand in a flow connection with one another, wherein the casting channel has a subdivision device that is configured in such a manner that when the casting mold, together with the casting channel, is tilted, predetermined volumes of a casting melt flow through the outlets, and wherein the casting channel does not co-form the mold cavity or the at least two mold cavities.

2. Apparatus according to claim 1, wherein subdivided volumes within the casting channel stand in a flow connection in the region of a longitudinal side that lies opposite the outlets.

3. Apparatus according to claim 1, wherein the flow connection, in the transverse direction amounts to ¼ to ¾ of the length of the casting channel in the transverse direction.

4. Apparatus according to claim 1, wherein the casting channel is disposed on the casting mold in such a manner that the casting channel is open toward the top in a starting position of the casting mold before tilting.

5. Apparatus according to claim 1, wherein the subdivision device is funnel-shaped or shell-shaped in the region of the outlets.

6. Apparatus according to claim 1, wherein the outlet, in each instance, is disposed at the low point of the subdivision device, in the end position of the casting mold after tilting.

7. Apparatus according to claim 1, wherein at least individual ones of the predetermined volumes are the same size or of different sizes.

8. Apparatus according to claim 1, wherein at least individual ones of the outlets are the same size or of different sizes.

9. Apparatus according to claim 1, wherein the casting mold, together with the casting channel, is tilted by up to 90°.

10. Apparatus according to claim 1, wherein the casting channel has a casting pool at one of its face sides.

11. Apparatus according to claim 1, wherein the casting channel has the capacity sufficient to completely hold the casting melt required for the casting in a starting position of the casting mold before tilting, without inflow of the casting melt into the mold cavity or mold cavities taking place.

12. Apparatus according to claim 1, wherein the casting mold is a first casting mold, wherein at least a second casting mold is disposed next to the first casting mold, wherein the first and second casting molds are tilted by way of a common tilt axis, wherein the second casting mold has one or more mold cavities, and wherein the second casting mold has a separate casting channel.

13. Apparatus according to claim 1, wherein a robot arm is provided, which has a number of casting ladles corresponding to the number of casting channels for parallel scooping and transport of the casting melt, as well as for parallel filling of the casting melt into the casting channel.

14. Apparatus according to claim 1, wherein the components are cast from light metal.

15. Apparatus according to claim 3, wherein the flow connection in the transverse direction amounts to ⅓ to ⅔ of the length of the casting channel in the transverse direction.

16. Method for casting of a material, via bringing the material into a flowable state, via heating the material and introducing the material into at least one casting mold that can be tilted only about a longitudinal axis, according to a tilt-casting principle, wherein the casting mold is first rotated into a starting position, on a side so that a casting channel assigned to each casting mold, disposed on the at least one casting mold, and provided with at least two outlets comes to lie horizontally next to the casting mold, then the flowable material is introduced into the casting channel from above, subsequently, the at least one casting mold, together with the casting channel, is tilted back to the vertical or beyond the vertical so that the flowable material flows, at predetermined volumes, through the outlets assigned to individual volumes, into at least one mold cavity of the casting mold, each mold cavity having at least one outlet and not standing in a flow connection with one another, the casting channel not co-forming the at least one mold cavity.

17. Method according to claim 16, wherein a casting channel having a subdivision device is configured in such a manner that when the casting mold, together with the casting channel, is tilted, predetermined volumes of the casting melt flow through the outlets.

18. Method according to claim 16, wherein at least one core, which is formed from core-forming material and an inorganic binder, is placed into every mold cavity of the casting mold.

19. Method according to claim 16, wherein when using multiple casting molds disposed on only one tiltable longitudinal axis, the casting channels assigned to the casting molds are filled in parallel.

20. Method according to claim 16, wherein the casted material forms a high-pressure pump housing or a turbocharger housing.

* * * * *